US008847832B2

(12) United States Patent
Parsche et al.

(10) Patent No.: US 8,847,832 B2
(45) **Date of Patent: *Sep. 30, 2014**

(54) MULTIPLE POLARIZATION LOOP ANTENNA AND ASSOCIATED METHODS

(75) Inventors: Francis Eugene Parsche, Palm Bay, FL (US); Dennis Lee Tebbe, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 2492 days.

This patent is subject to a terminal disclaimer.

(21) Appl. No.: 11/609,046

(22) Filed: Dec. 11, 2006

(65) Prior Publication Data

US 2008/0136720 A1 Jun. 12, 2008

(51) Int. Cl.

| | |
|---|---|
| ***H01Q 11/12*** | (2006.01) |
| ***H01Q 7/00*** | (2006.01) |
| ***H01Q 21/24*** | (2006.01) |

(52) U.S. Cl.
CPC . *H01Q 7/00* (2013.01); *H01Q 21/24* (2013.01)
USPC ..... 343/743; 343/866; 343/732; 343/741

(58) Field of Classification Search
None
See application file for complete search history.

(56) References Cited

U.S. PATENT DOCUMENTS

| | | | | |
|---|---|---|---|---|
| 1,892,221 | A | 12/1932 | Runge | |
| 2,615,134 | A | 10/1952 | Carter | |
| 3,474,452 | A | 10/1969 | Bogner | |
| 4,083,006 | A * | 4/1978 | Yokoshima | 455/115.1 |
| 4,160,978 | A | 7/1979 | DuHamel | 343/742 |
| 4,588,993 | A | 5/1986 | Babij et al. | 343/351 |
| 5,838,283 | A | 11/1998 | Nakano | 343/741 |
| 5,977,921 | A | 11/1999 | Niccolai et al. | 343/741 |
| 6,515,632 | B1 * | 2/2003 | McLean | 343/741 |
| 6,522,302 | B1 | 2/2003 | Iwasaki | 343/726 |
| 6,600,451 | B2 * | 7/2003 | Mimura et al. | 343/741 |
| 6,911,947 | B1 * | 6/2005 | Cranor et al. | 343/741 |
| 2002/0098807 | A1 | 7/2002 | Saarnimo | 455/74 |
| 2006/0238430 | A1 * | 10/2006 | Morioka et al. | 343/742 |
| 2007/0024514 | A1 * | 2/2007 | Phillips et al. | 343/744 |
| 2008/0018546 | A1 * | 1/2008 | Nakanishi et al. | 343/733 |
| 2008/0136721 | A1 * | 6/2008 | Parsche et al. | 343/742 |
| 2008/0191955 | A1 * | 8/2008 | Manholm et al. | 343/797 |

OTHER PUBLICATIONS

Li et al., "Wideband Probe-fed Circularly Polarised Circular Loop Antenna", Electronics Letters, Sep. 1, 2005, vol. 41, No. 18.
Ojiro et al., "A Monopole-Fed Circularly Polarized Loop Antenna", Institute of Information Sciences & Electronics, University of Tsukuba, Japan; 1998 IEEE, No. 0-7803-4478-2.
David Jefferies, "Intermediate-sized Loop Antennas", p. 1-15; Internet: www.ee.surrey.ac.uk/personal/d.jefferies.

* cited by examiner

*Primary Examiner* — Trinh Dinh
(74) *Attorney, Agent, or Firm* — Allen, Dyer, Doppelt, Milbrath & Gilchrist, P.A.

(57) ABSTRACT

The multiple polarization loop antenna includes a circularly polarized loop antenna, which may utilize a loop electrical conductor and two signal feedpoints along the loop electrical conductor separated by one quarter of the length of the loop circumference for a signal feedpoint phase angle input difference of 90 degrees. Each of the signal feedpoints may include a loop discontinuity, so that at least one signal source coupled thereto provides circular polarization from the loop electrical conductor. The circularly polarized loop antenna provides an increase in gain and decrease in size relative to the dipole turnstile. It can provide two orthogonal polarizations from two isolated ports, and the polarizations may be dual linear or dual circular.

17 Claims, 9 Drawing Sheets

MULTIPLE POLARIZATION LOOP ANTENNA AND ASSOCIATED METHODS

FIELD OF THE INVENTION

The present invention relates to the field of communications, and more particularly, to loop type antennas, circular polarization, dual polarization antennas and related methods. It also relates to traveling wave antennas.

BACKGROUND OF THE INVENTION

The use of satellite communications has increased the demand for circularly polarized antennas and for dual polarization antennas. For instance, many of the satellite transponders in use today carry two programs on the same frequency by using separate polarizations. Thus, single antenna structure may be called upon to simultaneously receive two polarizations, or perhaps to transmit in one polarization and receive in another. The single antenna structure must therefore separate the two polarization channels, to a high degree of isolation.

It is possible to have dual linear or dual circular polarization channel diversity. That is, a frequency may be reused if one channel is vertically polarized and the other horizontally polarized. Or, a frequency can also be reused if one channel uses right hand circular polarization (RHCP) and the other left hand circular polarization (LHCP). Polarization refers to the orientation of the E field in the radiated wave, and if the E field vector rotates in time, the wave is then said to be rotationally or circularly polarized.

Smaller, lighter, lower power receivers are now being developed to satisfy a variety of operational needs. For example, a small, lightweight, low-power, 4-channel satellite receiver (PCI computer card) will soon be fielded to meet the needs of many size-constrained platforms. Today, the antenna may be the only piece of associated equipment that remains to be miniaturized for use in various environments An electromagnetic wave (and radio wave, specifically) has an electric field that varies as a sine wave within a plane coincident with the line of propagation, and the same is true for the magnetic field. The electric and magnetic planes are perpendicular and their intersection is in the line of propagation of the wave. If the electric-field plane does not rotate (about the line of propagation) then the polarization is linear. If, as a function of time, the electric field plane (and therefore the magnetic field plane) rotates, then the polarization is rotational. Rotational polarization is in general elliptical, and if the rotation rate is constant at one complete cycle every wavelength, then the polarization is circular. The polarization of a transmitted radio wave is determined in general by the transmitting antenna (and feed)—by the type of the antenna and its orientation. For example, the monopole antenna and the dipole antenna are two common examples of antennas with linear polarization. A helix antenna is a common example of an antenna with circular polarization, and another example is a crossed array of dipoles fed in quadrature. Linear polarization is usually further characterized as either Vertical or Horizontal. Circular Polarization is usually further classified as either Right Hand or Left Hand.

The dipole antenna has been perhaps the most widely used of all the antenna types. It is of course possible however to radiate from a conductor which is not constructed in a straight line. Preferred antenna shapes are often Euclidian, being simple geometric shapes known through the ages. In general, antennas may be classified as charge separation or charge conveyance types, corresponding to dipoles and loops, and line and circle structures.

Circular polarization for dipole antennas has been attributed to George Brown, which was described in the literature as "The Turnstile Antenna", *Electronics*, 9, 15, April 1936. Approaches to circular polarization in loop antennas appear lesser known, or perhaps even unknown in the purest forms. For instance, the present edition "Antenna Engineering Handbook", R. Johnson and H. Jasik editors, does not describe methods to obtain circular polarization from loop antennas. In spite of the higher gain of the full wave loop vs. the half wave dipole (3.6 dBi vs. 2.1 dBi), dipoles are commonly used for circular polarization needs, as for instance in turnstile arrays. Both the dipole turnstile and a single loop antenna are planar, in that their thin structure lies nearly in a single plane.

Many structures are described as loop antennas, but canonical loop antennas are a circle. The resonant loop is a full wave circumference circular conductor, often called a "full wave loop". The typical prior art full wave loop is linearly polarized, having a radiation pattern that is a two petal rose, with two opposed lobes normal to the loop plane, and a gain of about 3.6 dBi. Reflectors are often used with the full wave loop antenna to obtain a unidirectional pattern.

Dual linear polarization (simultaneous vertical and horizontal polarization from the same antenna) has commonly been obtained from crossed dipole antennas. For instance, U.S. Pat. No. 1,892,221, to Runge, proposes a crossed dipole system. A dual polarized loop antenna could be more desirable however, as loops provide greater gain in smaller area. An existing, prior art approach to dual polarization in single loops does not come to mind.

U.S. Pat. No. 5,977,921 to Niccolai, et al. and entitled "Circular-polarized Two-way Antenna" is directed to an antenna for transmitting and receiving circularly polarized electromagnetic radiation which is configurable to either right-hand or left-hand circular polarization. The antenna has a conductive ground plane and a circular closed conductive loop spaced from the plane, i.e., no discontinuities exist in the circular loop structure. A signal transmission line is electrically coupled to the loop at a first point and a probe is electrically coupled to the loop at a spaced-apart second point. This antenna requires a ground plane and includes a parallel feed structure, such that the RF potentials are applied between the loop and the ground plane. The "loop" and the ground plane are actually dipole half elements to each other, and the invention is related to microstrip antennas.

U.S. Pat. No. 5,838,283 to Nakano and entitled "loop antenna for radiating circularly polarized waves" is directed to a loop antenna for a circularly polarized wave. Driving power fed may be conveyed to a feeding point via an internal coaxial line and a feeder conductor is transmitted through an I-shape conductor to a C-type loop element disposed in spaced facing relation to a ground plane. By the action of a cutoff part formed on the C-type loop element, the C-type loop element radiates a circularly polarized wave, Dual linear, or dual circular polarization are not however provided.

U.S. Pat. No. 6,522,302 to Iwasaki and entitled "circularly-polarized antennas" is directed to a circularly polarized antenna array rather than a single circularly polarized loop element. A circle is among the most elemental of antenna structures, and it is the most fundamental single geometry capable of circular polarization.

There is a longstanding requirement then, to obtain circular polarization from a single loop antenna, such as the full wave circumference circular conductor, and to identify a polarization method for loops dual to the turnstile for dipoles. A method is also needed, to obtain dual linear or dual circular polarization from a single loop antenna. Finally, there has been a practical need for a relatively compact loop antenna with dual polarization, linear or circular, such as to meet the requirements of today's multiplexed satellite communications.

SUMMARY OF THE INVENTION

In view of the foregoing background, it is therefore an object of the present invention to provide a circularly polarized loop antenna, a dual linearly polarized loop antenna, and a dual circularly polarized loop antenna with an increase in gain and decrease in size.

This and other objects, features, and advantages in accordance with the present invention are provided by a circularly polarized loop antenna comprising a loop electrical conductor, and two signal feedpoints along the loop electrical conductor and separated by one quarter of a length of the loop electrical conductor for a signal feedpoint phase angle input difference of 90 degrees. Each of the signal feedpoints preferably includes a series signal feedpoint so that at least one signal source coupled thereto provides circularly polarization for the loop electrical conductor.

The series signal feedpoint preferably defines a discontinuity in the loop electrical conductor. The loop electrical conductor may comprise a circular electrical conductor. At least one of the signal feedpoints may further include a two-wire transmission line connected in series at the respective series signal feedpoint. Also, a feed structure may include a direct leg and a phase inducing leg connected in parallel to the series signal feedpoints. The loop electrical conductor may have a length equal to one wavelength.

Another aspect of the invention is directed to a circularly polarized loop antenna including a loop electrical conductor, and a plurality of signal feedpoints along the loop electrical conductor. Each of the signal feedpoints may include a series signal feedpoint so that at least one signal source coupled thereto provides circular polarization for the loop electrical conductor. The series signal feedpoint may define a discontinuity in the loop electrical conductor, and the loop electrical conductor may be a circular electrical conductor.

Also, each of the signal feedpoints may further comprise a two-wire transmission line connected in series at the respective series signal feedpoint. A feed structure may include a direct leg and a phase inducing leg connected in parallel to the series signal feedpoints. The antenna may be circularly polarized, and the loop electrical conductor may have a length equal to one wavelength.

A method aspect of the invention is directed to making a circularly polarized loop antenna forming an electrical conductor into a loop, and forming a plurality of signal feedpoints along the loop electrical conductor. Each of the signal feedpoints comprises a series signal feedpoint so that at least one signal source connected to the series feedpoints provides circular polarization for the loop electrical conductor.

Forming the plurality of signal feed points may include forming discontinuities in the loop electrical conductor, and forming the loop electrical conductor may comprise forming a circular electrical conductor. Providing the plurality of signal feed points may further comprise connecting a two-wire transmission line in series at the respective series signal feedpoint. A feed structure may be connected including a direct leg and a phase inducing leg connected in parallel to the series signal feedpoints. The loop electrical conductor may have a length equal to one wavelength.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
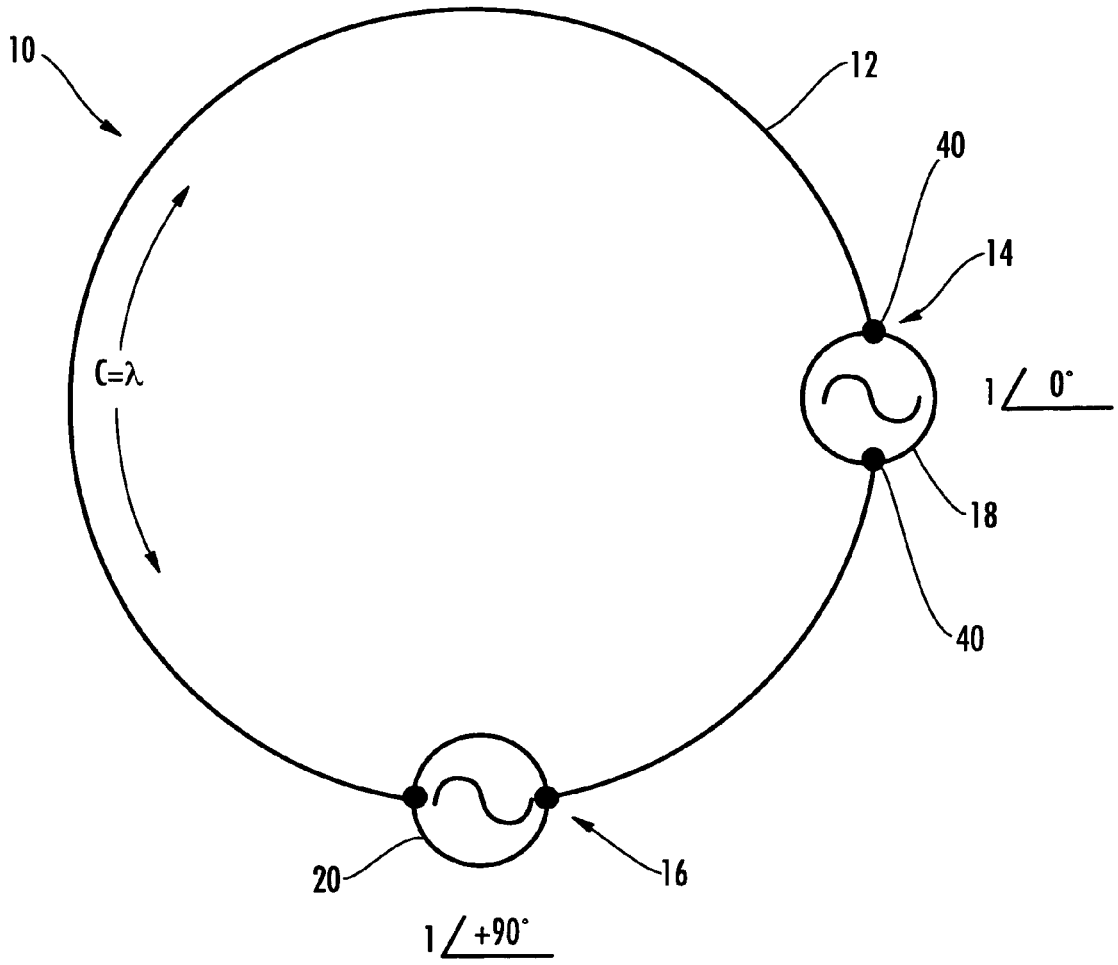
FIG. 1 is a schematic diagram of an embodiment of a circularly polarized loop antenna in accordance with the present invention.

Referring initially to FIG. 1, a circularly polarized loop antenna 10 according to an embodiment of the invention will now be described. A circle is among the most elemental of antenna structures, and it is the fundamental single geometry capable of circular polarization. However, in the present description, the term "circular" is intended to also include elliptical. The circularly polarized loop antenna 10 includes a loop electrical conductor 12, e.g. a circular electrical conductor. The loop electrical conductor 12 may be a conductive wire, tubing, trace etc., and the circumference is preferably equal to about one wavelength (e.g. between 0.9 and 1.1 wavelengths). Two signal feedpoints 14, 16 are configured along the loop electrical conductor and separated by one quarter of the length of the loop electrical conductor. A signal feedpoint phase difference of ninety degrees is provided at the signal feedpoints 14, 16, such that signal feedpoints 14, 16 operate in phase quadrature.

Each of the signal feedpoints 14, 16 may be a series signal feedpoint so that at least one signal source 18, 20 coupled thereto provides circular polarization from the loop electrical conductor 12. In other words, the signal feedpoints 14, 16 are in series in the loop electrical conductor 12. Each of the series signal feedpoints 14, 16 preferably defines a discontinuity in the loop electrical conductor 12. Each of the signal feedpoints 14, 16 may have two terminals 40, as is typical.

Figure 2:
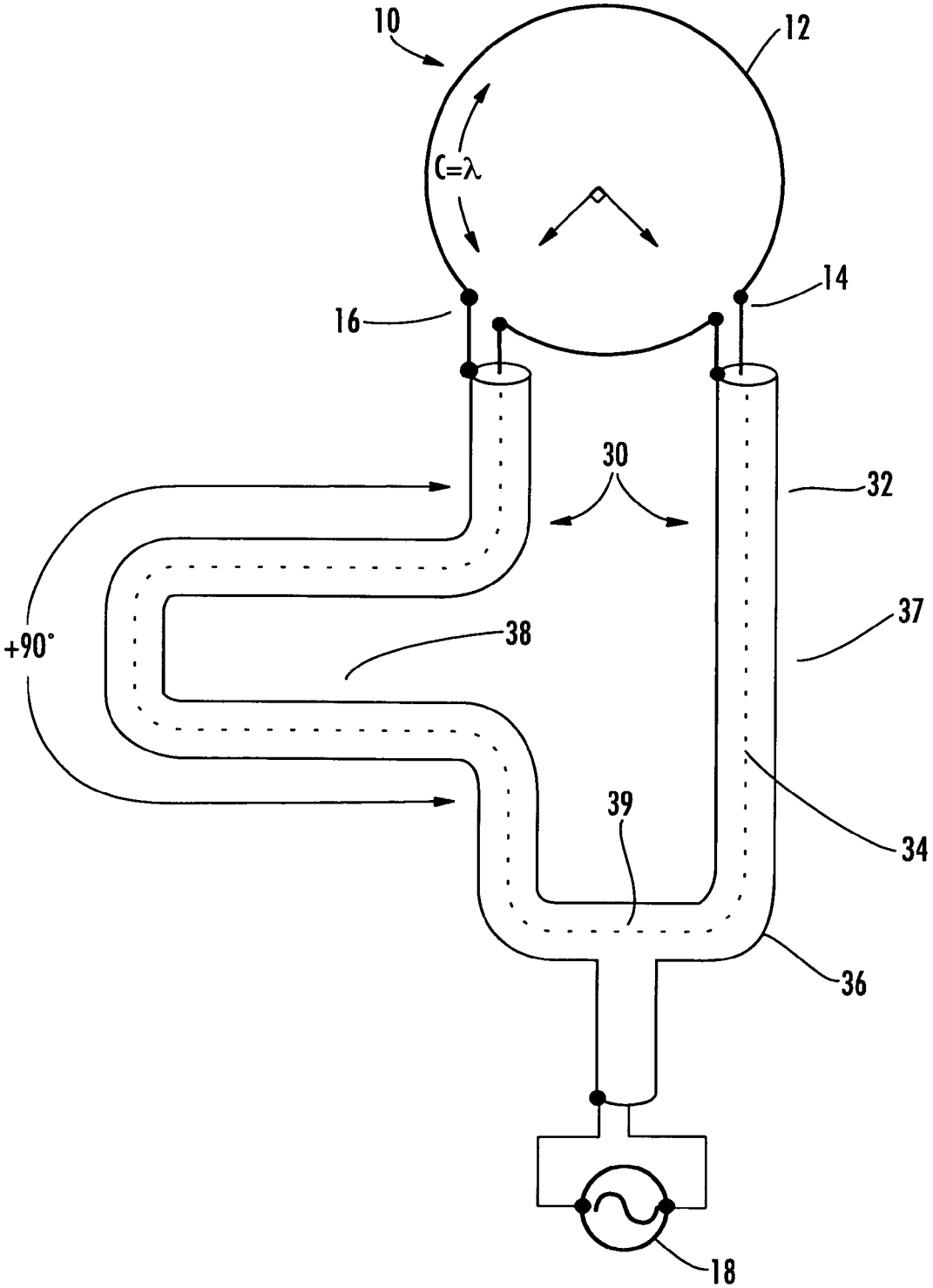
FIG. 2 is a schematic diagram of the circularly polarized loop antenna including a feed structure in accordance with an embodiment of the present invention.

An example of a signal feeding approach will be described with additional reference to FIG. 2. A power dividing beamforming network or feed structure 30 includes a coaxial cable 32 or two-wire transmission line connected in series at the respective series signal feedpoint 14, 16. The coaxial cable includes an inner conductor 34 and an outer conductor 36 in surrounding relation thereto. Also, the feed structure 30 may include a direct leg 37 and a phase inducing leg 38 connected in parallel to the series signal feedpoints 14, 16. The additional length of the phase inducing leg 38 creates the needed ninety degree phase angle input difference. Power is divided equally at common point 39, as the load resistance from either coaxial branch is equivalent. In the FIG. 2 circularly polarized loop antenna 10, right hand circular polarization (RHCP) is produced out of the page, and left hand circular polarization (LHCP) is produced into the page.

Both polarization senses are possible with this invention by controlling the phasing (e.g. reversing the phasing). The circularly polarized loop antenna has a current distribution that is uniform in amplitude and linear in phase, and the present invention is an antenna of the traveling wave type. The uniform current distribution produces a high, e.g. maximum, possible gain for area, without superdirectivity. An example of the performance of a circularly polarized loop antenna in accordance with the present invention is summarized in the table below.

NEC4.1 VIRTUAL PROTOTYPE PERFORMANCE CIRCULARLY POLARIZED LOOP ANTENNA

| | |
|---|---|
| Gain, Free Space | +3.6 dBic |
| Pattern Type | 2 Petal Rose |
| 3 dB Beamwidth | 98° |
| Coupling, Port to Port | −30.5 dB |
| Impedance, 0 Degree Port | 145 + j0 Ω |
| Impedance, 90 Degree Port | 129 + j0 Ω |
| Current Distribution | Traveling Wave |
| Polarization | Circular |
| Axial Ratio | 0.999 |
| XY Plane Pattern | Circular + Ripple |
| XY Plane Pattern Ripple | 1.8 dB |
| +Z Axis Polarization Sense | Selectable RHCP or LHCP |
| Exact Loop Circumference at Resonance | 1.03 λ |

The radiated field of the present invention in the Z direction (normal to the loop plane) has a constant magnitude over time which is described by $$E=(\cos^2 \omega t+\sin^2 \omega t)^{1/2}=1$$

which is the necessary condition for circular polarization.

A method aspect of the invention is directed to making a circularly polarized loop antenna 10 by forming an electrical conductor into a loop 12, and forming a plurality of signal feedpoints 14, 16 along the loop electrical conductor. Each of the signal feedpoints 14, 16 comprises a series signal feedpoint so that at least one signal source 18, 20 connected to the series feedpoints provides circular polarization for the loop electrical conductor 12.

Forming the plurality of signal feed points 14, 16 may include forming discontinuities in the loop electrical conductor 12, and forming the loop electrical conductor may comprise forming a circular electrical conductor. Providing the plurality of signal feed points 14, 16 may further comprise connecting a two-wire transmission line 32 in series at the respective series signal feedpoint. A feed structure 30 may be connected including a direct leg 37 and a phase inducing leg 38 connected in parallel to the series signal feedpoints 14, 16. The loop electrical conductor 12 may have a length equal to one wavelength, that is, the circumference of loop electrical conductor 12 may be one wavelength.

Figure 3:
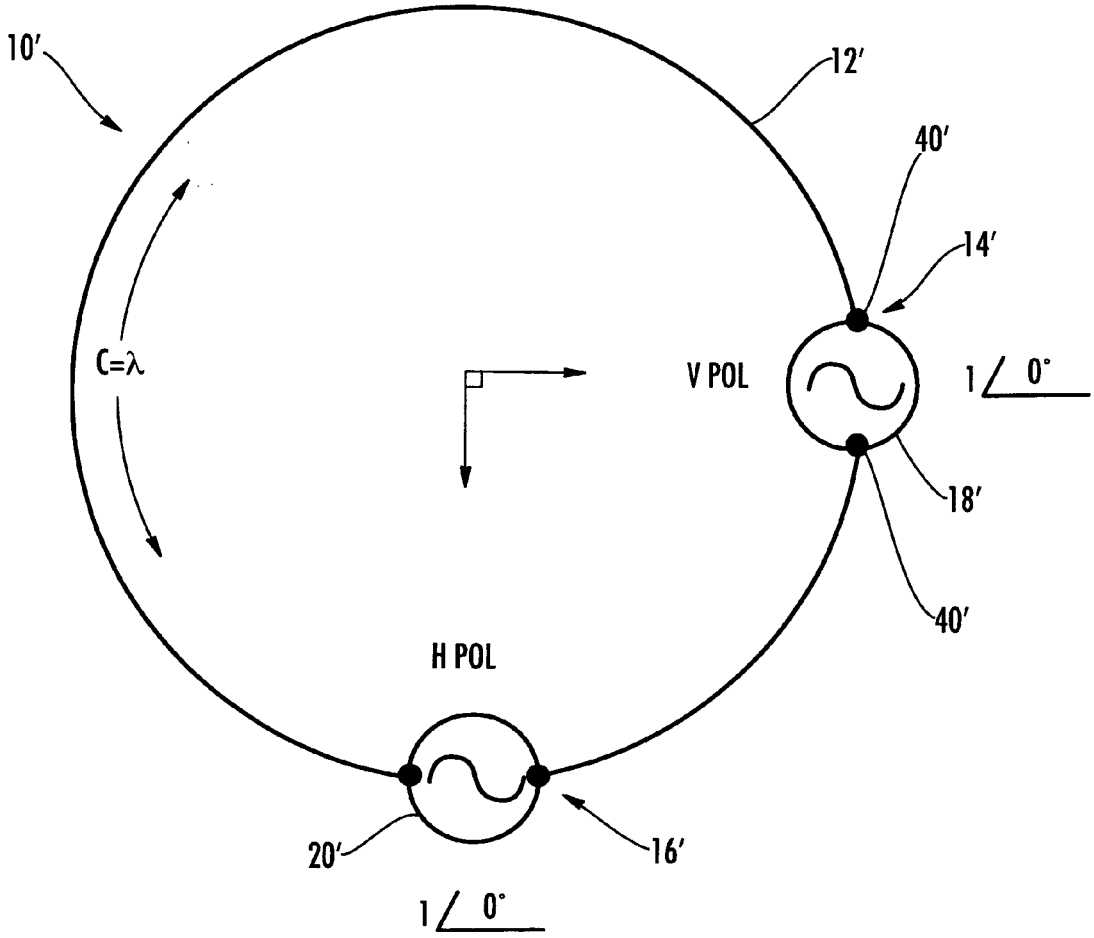
FIG. 3 is a schematic diagram of another embodiment, a dual linearly (simultaneous vertical and horizontal) polarized loop antenna in accordance with the present invention.

Referring now to FIG. 3, another embodiment of the antenna will be described. It is directed to a dual linearly polarized loop antenna 10' providing simultaneous vertical and horizontal polarization from two isolated ports. The dual linearly polarized loop antenna 10' is a 2-channel system, which can provide polarization diversity, and may have the effect of producing greater penetration into buildings and difficult reception areas than a signal with just one plane of polarization. In dual linear loop antenna 10', the vertical and horizontal polarized ports are isolated from one another, and may also be used as independent communication channels, or for duplex communications. For instance, a transmitter may be included at one of the signal feedpoints, and a receiver used at the other.

The dual linear loop antenna 10' includes a loop electrical conductor 12', e.g. a circular electrical conductor. The loop electrical conductor 12' may be a conductive wire, tubing, trace etc., and the circumference is preferably equal to one wavelength. Two signal feedpoints 14', 16' are along the loop electrical conductor and separated by one quarter of a length of the loop electrical conductor. One signal feedpoint 14' may be referred to as the vertical polarized port and include a signal source 18' connected in series in the loop electrical conductor 12'. The other signal feedpoint 16' may be referred to as the horizontal polarized port and include a signal source 18' connected in series in the loop electrical conductor 12'.

Each of the signal feedpoints 14', 16' is a series signal feedpoint and the signal sources 18', 20' coupled thereto provide the simultaneous vertical and horizontal polarization for the loop electrical conductor 12'. Each of the series signal feedpoints 14', 16' preferably defines a discontinuity in the loop electrical conductor 12'. Each of the signal feedpoints 14', 16' may have two terminals 40', as is typical.

Figure 4:
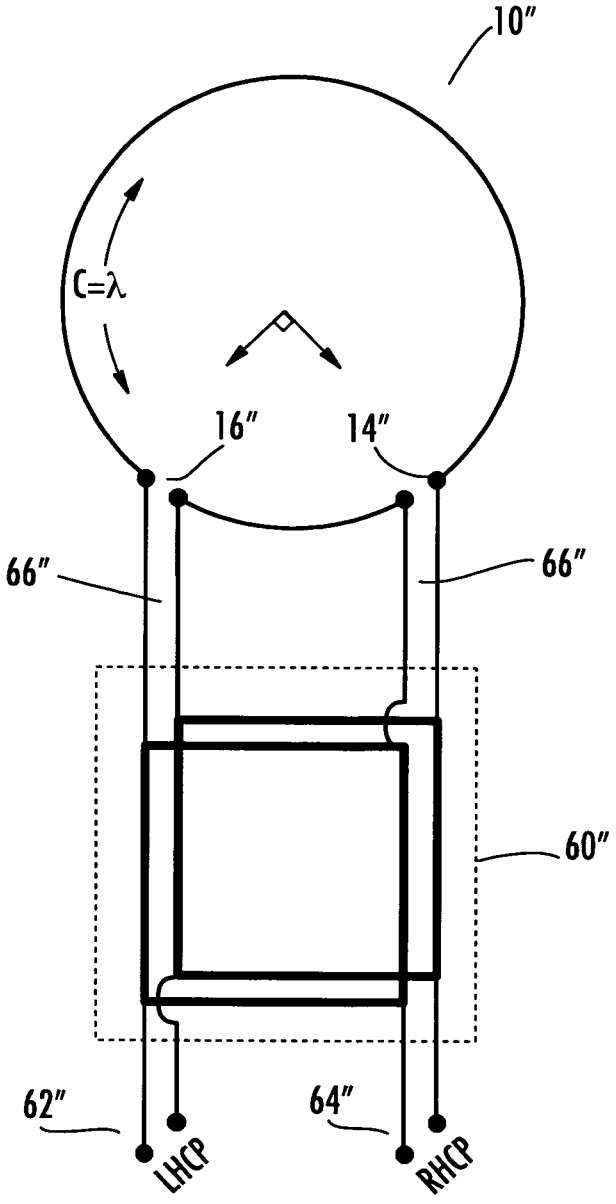
FIG. 4 is a schematic diagram of an embodiment of a dual circularly polarized loop antenna, including a feed structure providing simultaneous right and left hand circular polarization.

Referring now to FIG. 4, a dual circularly polarized embodiment (10") of the present invention will now be described. In the FIG. 4 dual circularly polarized loop antenna 10", ports (62", 64") provide LHCP and RHCP respectively, and simultaneous operation in the two polarizations is possible as ports (62", 64") are uncoupled from each other. A quadrature hybrid unit 601' drives the dual circularly polarized loop antenna 10' at series signal feedpoints (14", 16") providing the necessary 0, 90 degree phasing for the circular polarization, as well as the isolation between ports (62", 64"). Although FIG. 4 depicts a branch line type quadrature hybrid, the invention is not so limited, as any type of quadrature hybrid unit may be used such as a hybrid transformer. Isolation between ports (62", 64") is theoretically infinite, and 20 to 30 dB may be typical in practice.

The FIG. 4 dual circularly polarized loop antenna embodiment may be used, for example, for full duplex communications, where a transmitter may simultaneously be operated at port 62" and a receiver at port 64" without mutual interference. Or it may be used with dual polarized satellite transponders, providing separate program channels on RHCP and LHCP.

Referring again to the FIG. 4 embodiment, transmission lines 66" are used to convey the radio frequency energy to and from quadrature hybrid 60" to antenna 10" without radiation. These are depicted as open wire types for simplicity, although coaxial cable may be used. Also, baluns may be used at any of the series signal feedpoints (14, 16), (14', 16'), (14", 16") in any embodiment of the present invention, to control coaxial feedline radiation as is common practice.

The FIG. 4 dual circularly polarized loop antenna embodiment may be advantageous at high (HF) frequencies for NVIS (near vertical incidence skywave) communications, with ports (62", 64") being selected for best radio propagation. RHCP can be preferential in the northern hemisphere and LHCP in the southern hemisphere, due to electron rotation (gyro resonance) in the ionosphere.

If a 0 degree type hybrid is substituted for quadrature hybrid 60", in the FIG. 4 dual circularly polarized loop antenna embodiment, the polarization obtained becomes dual linear rather than dual circular. The FIG. 3 dual linear polarization embodiment is preferable however for most linear polarization needs, as it does not require a hybrid feed network.

Figure 5:
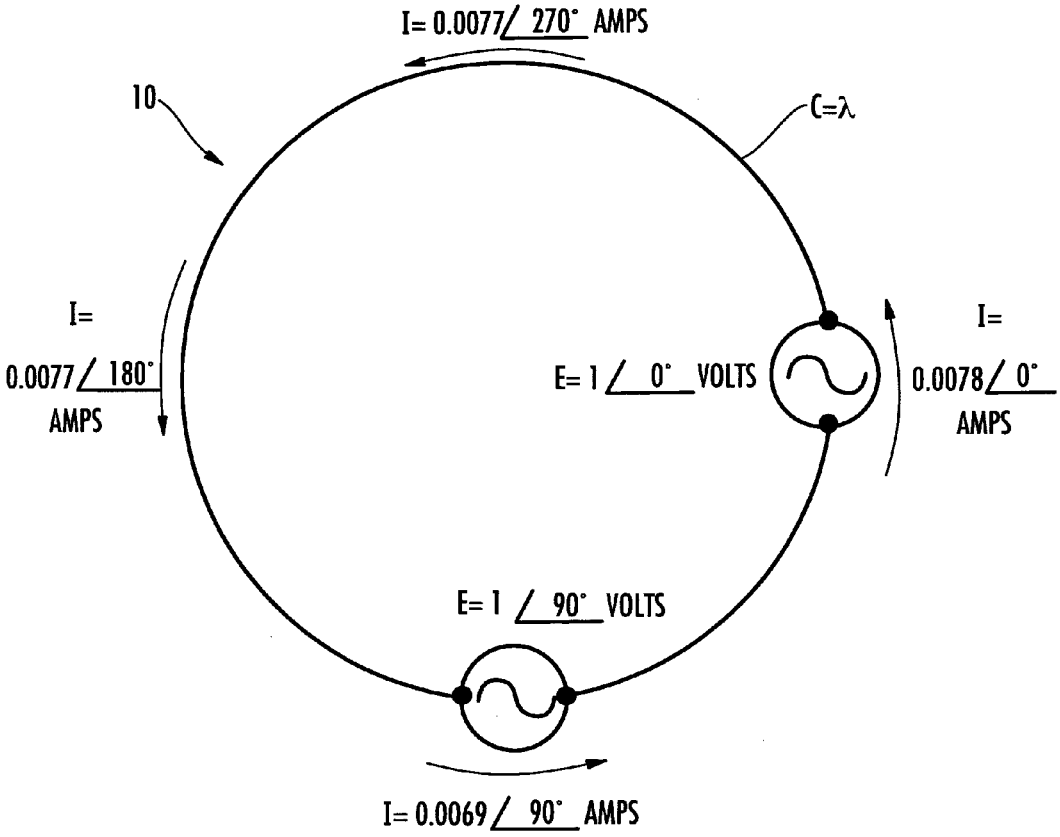
FIG. 5 is a schematic diagram illustrating an example of the current distribution along the circularly polarized loop antenna of FIG. 1.

FIG. 5 depicts the current distribution present along a circularly polarized loop antenna 10, as calculated from a method of moments model. The 0 and 90 degree excitations at signal feed points 14, 16 superimpose sine and cosine currents, producing a uniform amplitude current distribution and a linear phase distribution along the circular loop conductor: the present invention may therefore be considered to be a traveling wave antenna. Prior art linearly polarized full wave loop antennas, which have a single driving point, have a current amplitude distribution that is sinusoidal and a standing wave, and a phase progression that is piecewise. With the exception of superdirectivity, uniform distributions produce the maximum directivity and gain relative to area.

The circularly polarized loop antenna radiates a circularly polarized wave because the traveling wave current distribution is conveyed circularly. That is, although loop electrical conductor 12 does not physically rotate, the charge distribution upon it rotates. It does so linearly in time at an angular rate of $2\pi f$ radians/second. Prior art traveling wave antennas generally have been linear rather then circular structures, radiating linear rather than circular polarization. The conventional dipole turnstile has a rotating charge separation between the dipole arms.

Figure 6:
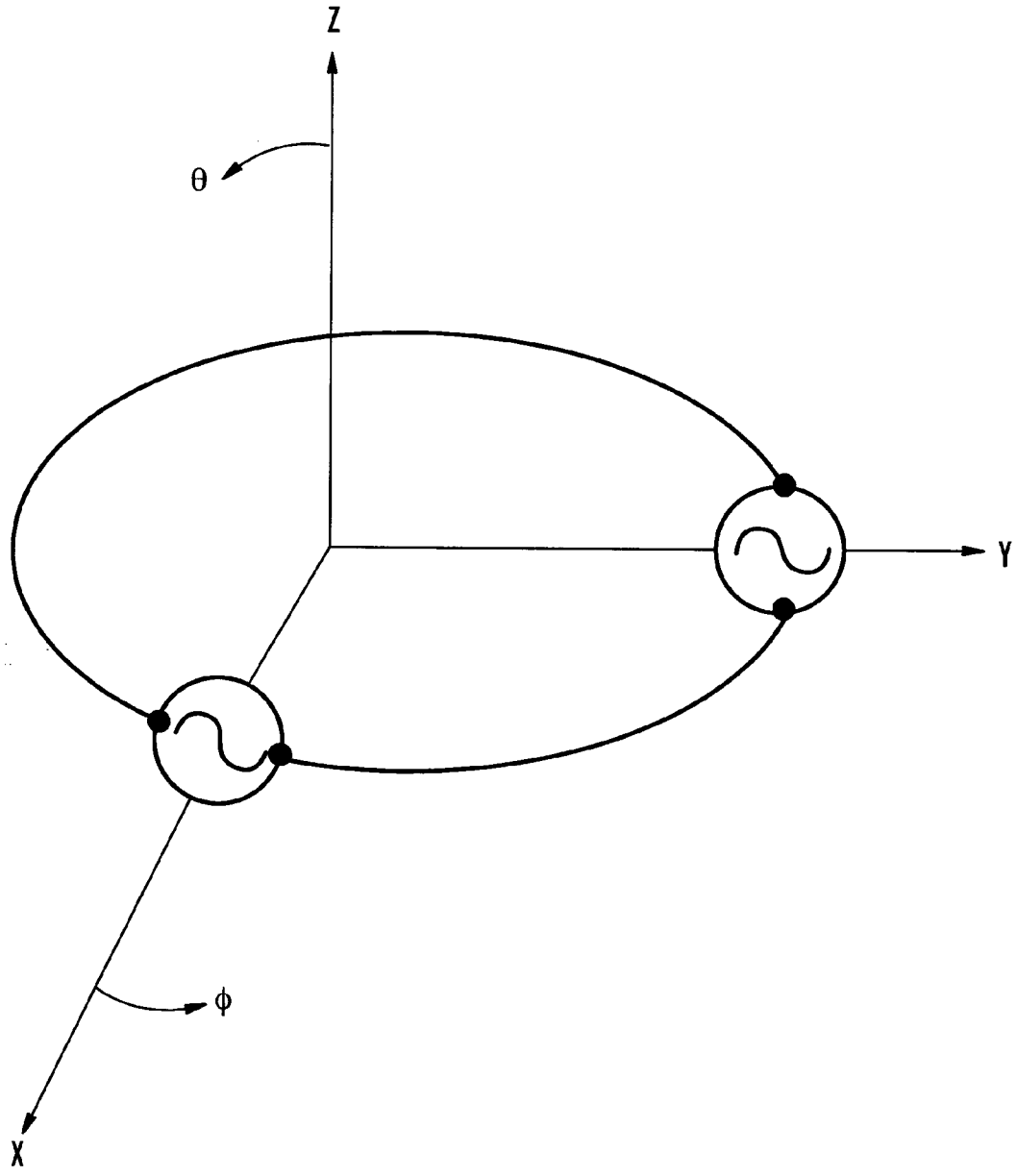
FIG. 6 is a diagram depicting the circularly polarized loop antenna of FIG. 1 in a standard radiation pattern coordinate system.
Figure 7A:
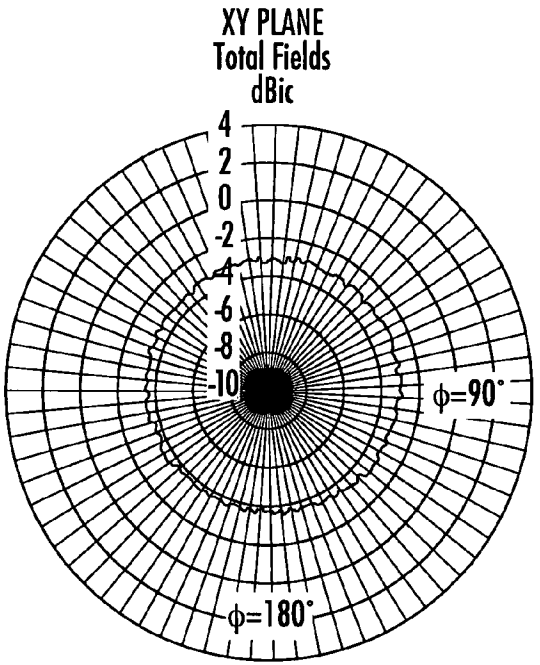
FIGS. 7A-7C are graphs depicting the principal plane radiation patterns of the circularly polarized loop antenna of FIG. 1 in free space.
Figure 7B:
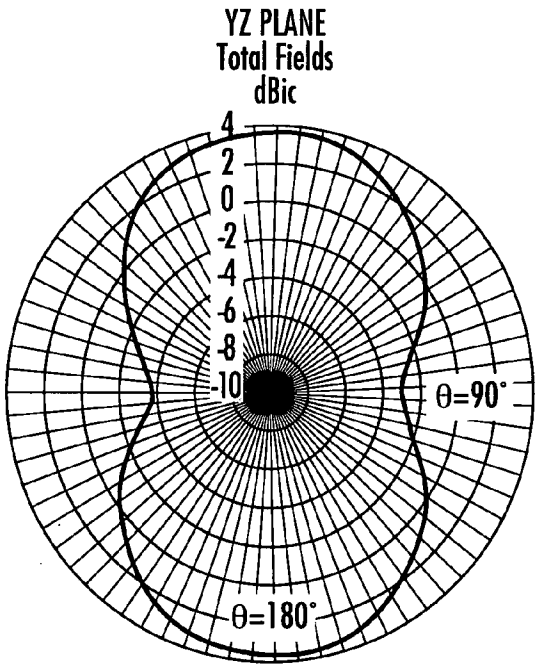
Figure 7C:
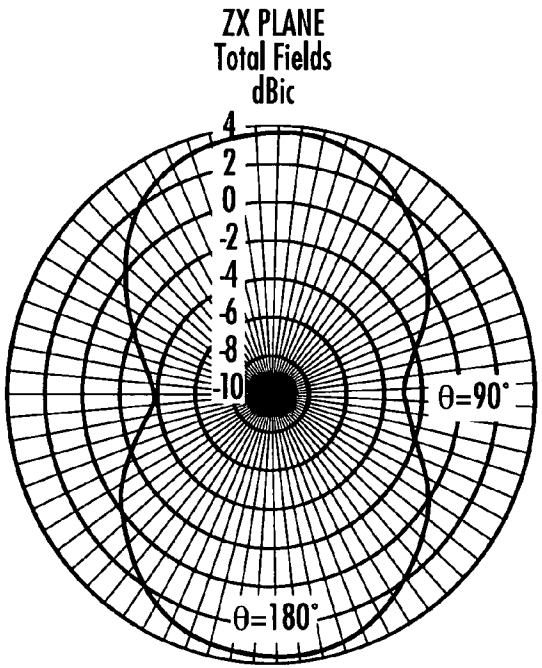

FIG. 6 depicts the present invention in a standard radiation pattern coordinate system, and examples of the principal plane far field radiation pattern cuts (XY, YZ, ZX) for the present invention circularly polarized loop antenna are depicted in FIGS. 7A-7C. These patterns were obtained by moment method numerical electromagnetic modeling (NEC4.1 code), and are for operation in free space. Total fields are plotted. The gain units are dBic, indicating that the gain is expressed in decibels relative to an isotropic radiator that is circularly polarized.

Figure 8:
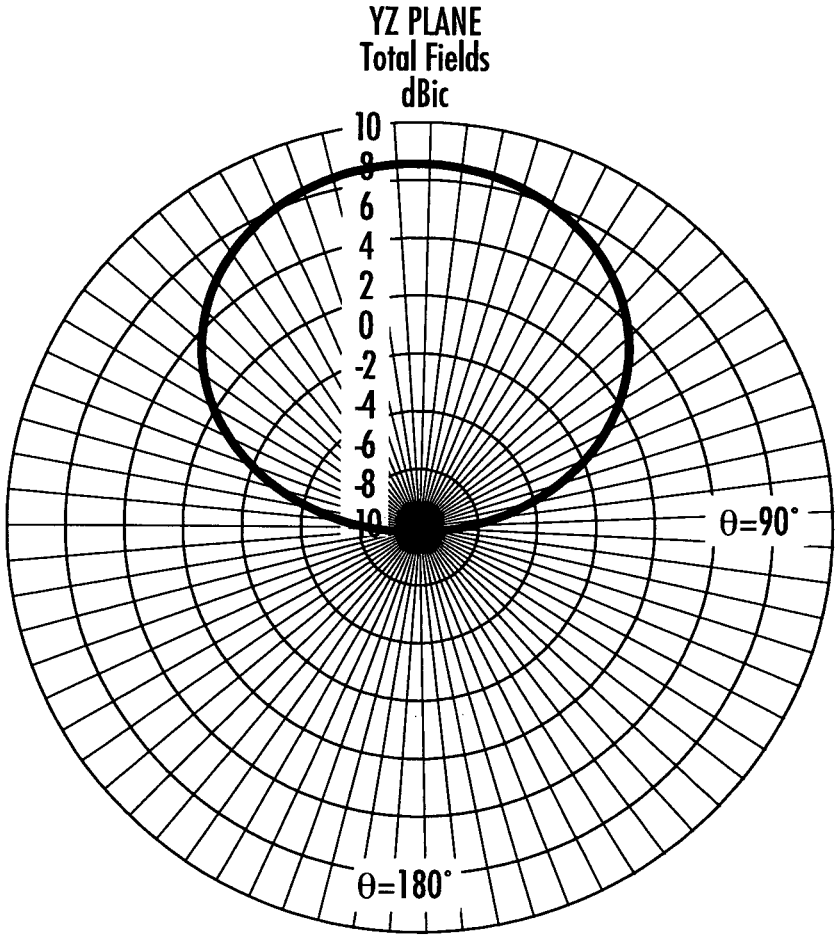
FIG. 8 is a graph depicting an elevation cut far field radiation pattern of the circularly polarized loop antenna of FIG. 1, when located ¼ wavelength from an electrically large plane reflector.

A unidirectional radiation is desirable for many purposes. FIG. 8 provides an elevation plane pattern cut of the present invention when it is operated ¼ wavelength away from a electrically large plane reflector. (The reflector was operated without electrical connection to the present invention, i.e, it was a true optical reflector and not a ground plane.)

Cup reflectors are well suited for the present invention as well, as are common with dipole turnstiles. Loop reflectors and loop directors may also be configured, with the present invention being the driven element, to form a circularly polarized Yagi-Uda type parasitic array.

Figure 9:
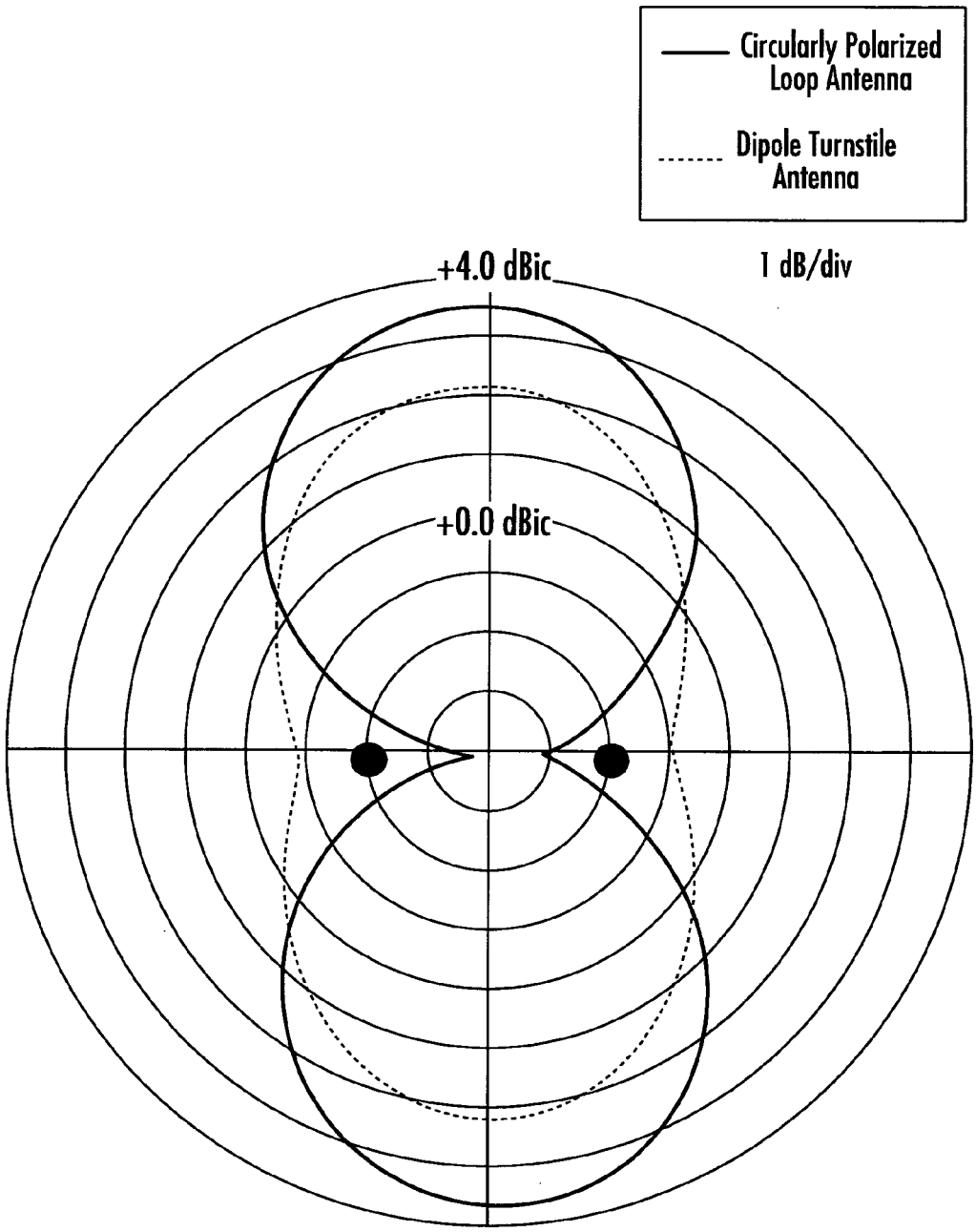
FIG. 9 is a graph depicting an elevation cut far field radiation pattern for circularly polarized loop antenna of FIG. 1, compared with a ½ wave dipole turnstile antenna, mounted in the same plane.

The elevation (XZ plane) cut radiation pattern for the circularly polarized loop antenna embodiment of the present invention is compared with that of a conventional ½ wave dipole turnstile antenna in FIG. 9. As can be appreciated, the circular polarized loop antenna has a gain of 3.6 dBic compared to 2.1 dBic of a conventional % wave dipole turnstile antenna, resulting in an increase of 1.4 dB. This higher gain is obtained in less physical area as well.

Exact resonance in the present invention circularly polarized loop antenna occurs at slightly larger than 1 wavelength nominal circumference. For small diameter loop conductors, it has been found to be 1.03 to 1.04 wavelengths. This is in reverse to thin half wave dipoles, where exact resonance may occur at slightly shorter than nominal length, such as 0.47 or 0.48 wavelengths.

Although 1 wavelength circumference is a preferred embodiment for loop 12, the invention continues to produce circular polarization for smaller loop diameters.

The present invention is not so limited as to require discontinuities in the loop conductor at signal feed points 14, 16, and other signal feed approaches may be used, as for example, shunt feeding. The gamma or Y match are suitable shunt feeds, as are common in dipole and yagiuda antenna practice.

Inset feed approaches may also be used to form signal feed points 14, 16. For instance, loop electrical conductor 12 may be made of coaxial cable, and the radiating current a common mode current on the outside of a coaxial cable loop. The coax cable braid may be spread, but not severed, to bring the center conductor out at the desired location, and the signal feed points 14, 16 formed by a discontinuity the coaxial cable loops outer conductor.

Other loop shapes may be substituted in the present invention, with qualitatively similar results. For instance the full wave circular loop may be made square, with ¼ wavelength sides, or even triangular. If used with a square reflector or directors, the present invention can form circularly polarized version of the Quad Antenna, as is common in amateur radio.

Three embodiments of the present invention have been described then: the circularly polarized loop antenna, the dual linearly polarized loop antenna, and the dual circularly polarized loop antenna. As will be apparent to those skilled in the art, various switching schemes may be employed to reconfigure the embodiments of present invention, so that linear or circular polarization, with single or dual orthogonal channels, can be obtained at will from a single loop radiating element.

Accordingly, a multiple polarization loop antenna is provided with an increase in gain and decrease in size. The antenna according to the present invention uses two feedpoints in series in the loop conductor. The antenna uses quadrature phasing (zero and ninety degrees) at the feedpoints and is a true loop antenna that does not require a ground plane. The antenna preferably has a traveling wave current distribution, providing a high, e.g. maximum, possible gain for the area.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A circularly polarized loop antenna comprising:

a loop electrical conductor; and two signal feedpoints along the loop electrical conductor and separated by one quarter of a length of the loop electrical conductor for a signal feedpoint phase angle input difference of 90 degrees;

each of said signal feedpoints comprising a series connected signal feedpoint so that at least one signal source coupled thereto provides circular polarization for said loop electrical conductor.

2. The circularly polarized loop antenna according to claim 1, wherein each of said series connected signal feedpoints defines a discontinuity in said loop electrical conductor.

3. The circularly polarized loop antenna according to claim 1, wherein said loop electrical conductor comprises a circular electrical conductor.

4. The circularly polarized loop antenna according to claim 1, wherein at least one of said signal feedpoints further comprises a two-wire transmission line connected in series at said respective series connected signal feedpoint.

5. The circularly polarized loop antenna according to claim 1, further comprising a feed structure including a direct leg and a phase inducing leg connected in parallel to corresponding ones of said series connected signal feedpoints.

6. The circularly polarized loop antenna according to claim 1, further comprising a quadrature hybrid feed structure, connected to said series connected signal feedpoints.

7. The circularly polarized loop antenna according to claim 1, wherein each of the signal feedpoints is a shunt connection across a continuous loop electrical conductor.

8. A circularly polarized loop antenna comprising:

a loop electrical conductor;

a plurality of signal feedpoints along the loop electrical conductor;

each of said signal feedpoints comprising a connected series signal feedpoint so that at least one signal source coupled thereto provides circular polarization for said loop electrical conductor.

9. The circularly polarized loop antenna according to claim 8, wherein each of said series connected signal feedpoints defines a discontinuity in said loop electrical conductor.

10. The circularly polarized loop antenna according to claim 8, wherein said loop electrical conductor comprises a circular electrical conductor.

11. The circularly polarized loop antenna according to claim 8, wherein each of said signal feedpoints further comprises a two-wire transmission line connected in series at said respective series connected signal feedpoint.

12. The circularly polarized loop antenna according to claim 8, further comprising a feed structure including a direct leg and a phase inducing leg connected in parallel to corresponding ones of said series connected signal feedpoints.

13. A method of making a circularly polarized loop antenna comprising:

forming an electrical conductor into a loop; and forming a plurality of signal feedpoints along the loop electrical conductor, each of the signal feedpoints comprising a series connected signal feedpoint so that at least one signal source connected to the series feedpoints provides circular polarization for the loop electrical conductor.

14. The method according to claim 13, wherein forming the plurality of signal feed points comprises forming discontinuities in the loop electrical conductor.

15. The method according to claim 13, wherein forming the loop electrical conductor comprises forming a circular electrical conductor.

16. The method according to claim 15, wherein providing the plurality of signal feed points further comprises connecting a two-wire transmission line in series at the respective series connected signal feedpoint.

17. The method according to claim 15, further comprising connecting a feed structure including a direct leg and a phase inducing leg connected in parallel to corresponding ones of the series connected signal feedpoints.

* * * * *